United States Patent [19]

Bussert

[11] Patent Number: 5,074,022

[45] Date of Patent: Dec. 24, 1991

[54] METHOD FOR SELECTIVELY COVERING A WINDOW

[76] Inventor: Althea J. Bussert, P.O. Box 27808, Tempe, Ariz. 85282

[21] Appl. No.: 656,601

[22] Filed: Feb. 19, 1991

Related U.S. Application Data

[60] Division of Ser. No. 470,874, Jan. 26, 1990, Pat. No. 5,010,944, which is a continuation-in-part of Ser. No. 231,870, Aug. 12, 1988, Pat. No. 4,909,299, which is a continuation-in-part of Ser. No. 37,686, Apr. 13, 1987, Pat. No. 4,836,265.

[51] Int. Cl.[5] ..... B21K 21/16

[52] U.S. Cl. ..... 29/401.1; 29/432; 29/525; 29/525.1

[58] Field of Search ..... 29/24.5, 401.1, 432, 29/525, 525.1; 160/354, 368.1, 327, 328, 243, 242, DIG. 1, 387, 351, 135, 84.1, 348

[56] References Cited

U.S. PATENT DOCUMENTS

| | | | |
|---|---|---|---|
| 2,246,663 | 6/1941 | Bradshaw | 160/354 |
| 2,299,173 | 10/1942 | Pidgeon | 160/ |
| 2,514,316 | 7/1980 | Dobrin | 160/102 |
| 3,480,069 | 11/1969 | Handwerker | 160/368.1 X |
| 3,913,655 | 10/1975 | Ogino | 160/84.1 |
| 3,996,083 | 12/1976 | Morgan et al. | 160/348 X |
| 4,560,245 | 12/1985 | Sarver | 160/DIG. 3 X |

*Primary Examiner*—Timothy V. Eley
*Attorney, Agent, or Firm*—Cahill, Sutton & Thomas

[57] ABSTRACT

A method for selectively varying the length of a horizontally foldable covering includes suspending the lower part of the covering from a remaining part of the covering with suspension means. The suspension means, secured to the lower end of the covering, engages spaced apart vertical sections of the covering to fold the lower part of the covering over an upper section of the covering. The suspension means also permits retention upon upward folding of the folded part of the covering to further reduce the effective length of the covering.

14 Claims, 2 Drawing Sheets

METHOD FOR SELECTIVELY COVERING A WINDOW

CROSS REFERENCE TO RELATED APPLICATIONS

This is a divisional application of a co-pending application entitled "Vertically Foldable Window Covering and Retaining Clip", Ser. No. 470,874, filed Jan. 26, 1990, which is now U.S. Pat. No. 4,010,944, which is a continuation in part application of a copending application entitled "VERTICALLY ADJUSTABLE WINDOW COVERING AND CLIP", Ser. No. 231,870, filed Aug. 12, 1988, now U.S. Pat. No. 4,909,299, which is a continuation in part application of an application entitled "TEMPORARY WINDOW SHADES", filed on Apr. 13, 1987, assigned Ser. No. 037,686, now U.S. Pat. No. 4,836,265, all of which describe inventions by the present inventor.

BACKGROUND OF THE INVENTION

1. Field of the Invention

This invention relates to window coverings and, more particularly, to temporary selectively foldable window shades and clips therefor.

2. Description of the Prior Art

New home owners and renters very often find that they must wait a long time before they are able to install new shades or draperies across their windows. This is especially true in the case of custom made draperies, since the process of measuring, ordering and making the draperies is quite lengthy. Even ready made draperies are usually not purchased immediately as they are somewhat expensive and as the buyer usually shops around before finally selecting permanent draperies.

In order to protect one's privacy, as well as to block out bright sunlight, new occupants frequently resort to temporary measures, such as hanging sheets or pasting newspapers or the like over their windows. Such measures are usually unsatisfactory, as the sheets or newspapers are a nuisance to put up and tend to detract from the internal and external appearance of the house or apartment. In addition, there is no convenient way to raise and lower these types of window coverings. Accordingly, the occupant cannot readily vary the amount of light shining through the windows or selectively have a view of the outdoors.

The closest known attempt to solve the above problems is a temporary paper curtain which has a first strip of stiffener material attached to its top edge and a second strip of stiffener material attached to its bottom edge. The first strip serves as an attachment strip for attaching the curtain to a wall and the second strip serves as a weighting device to ensure that the curtain hangs correctly. In one embodiment of the device, bores are provided through each of the stiffener strips and a plurality of vertically spaced apart holes are provided along one side of the curtain. A pull cord passing through the bores and the aligned holes allow the curtain to be raised and lowered. This apparatus for raising and lowering the curtain is not entirely satisfactory, since the process of boring holes in the stiffener strips and threading the pull cord through the curtain adds to the cost and complexity of the product.

SUMMARY OF THE INVENTION

A sheet of rugged, relatively inexpensive material, such as nylon, polyester, or reinforced paper serves the function of covering a selected part of a window. The upper and lower edges of the covering are preferably folded to form hems and a stiffening rod is inserted into at least the lower hem to provide weight and urge the covering to hang flat. The hem along the top edge may be provided with double-sided adhesive tape, hook and loop type fasteners, or holes for receiving nails, hooks or the like, to secure the top edge to the upper window frame or a wall above the window. A pair of clips extend from the bottom stiffening rod. Each clip includes a support member supporting a planar flange extending in one direction and a hooked flange extending in the other direction. A plurality of slots and loops are formed in longitudinally spaced increments proximate each of the vertical edges of the covering. To raise the covering to a desired height, the covering is folded upwardly to positionally fix the bottom edge of the covering in the folded position by passing the hooked flange of each clip through a respective selected transversely aligned pair of slots in the covering. The folded part of the covering may be folded upwardly again and retained in place by penetrably engaging a transversely aligned pair of loops with the respective planar flanges. By easily disengaging the hooked flanges and planar flanges, the covering will unfold to its depending state and cover the underlying window.

A primary object of the present invention is to provide a vertically foldably adjustable temporary window covering for covering a selected part of a window.

Another object of the present invention is to provide an inexpensive window covering for covering a selectable portion of a window.

Yet another object of the present invention is to provide a clip for retaining at any of a plurality of locations a folded part of a window covering.

Still another object of the present invention is to provide a clip for selectively retaining multiple folds of a depending window covering.

A further object of the present invention is to provide an inexpensive clip attached to the lower edge of a window covering for positionally retaining one or more folds of the window covering to partially uncover the adjacent window.

A yet further object of the present invention is to provide a method for inexpensively covering a window to a selected extent.

A yet further object of the present invention is to provide a removably attached clip for retaining folded portions of a window covering to uncover a selected extent of an adjacent window.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENTS

Figure 1:
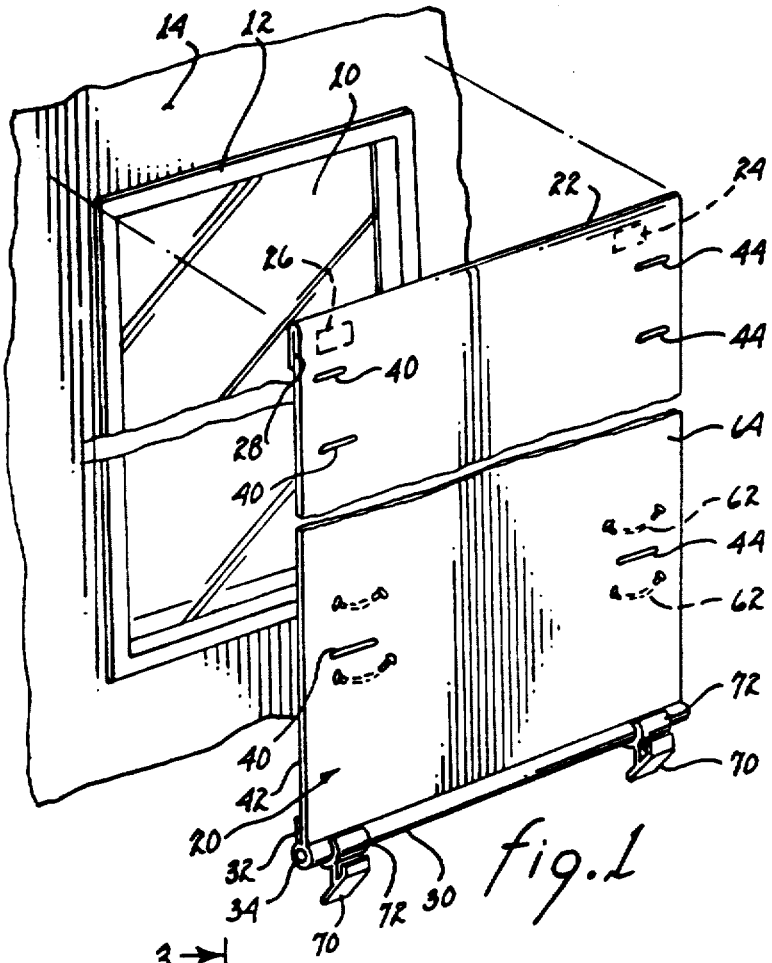
FIG. 1 is an isometric view of a depending window covering locatable adjacent a window.

Referring to FIG. 1, there is shown, in representative form, a window 10 mounted within a frame 12 in wall 14. The window may be any type of window, such as a permanently closed window, a sliding glass window, a casement window, etc. Similarly, frame 12 may be made of any material, such as wood, metal, plastic, etc. Wall 14 may be of conventional construction, stone, stucco, etc.

Coverings for windows are used predominantly to limit the light passing through the window and for reasons of privacy. In conjunction therewith, the type or nature of the window covering is selected primarily for decorative purposes, barring some other overriding concern. At the time of initial occupancy of a dwelling, the windows are usually uncovered pending a decision by the occupant as to type, nature and design of the window coverings. Until permanent window coverings are obtained and installed, the need exists, for reasons stated above, to cover the windows. Preferably, any window covering used for temporary purposes should be capable of being selectively positionable for control of light transmitted through the window and to provide the capability for looking out through the window.

Window covering 20 may be opaque, translucent or may even be of a visually transparent but ultraviolet opaque material. Preferably, it is somewhat tear resistent and readily foldable. Whether window covering 20 is of man-made composite materials, natural fibers or a blend is unimportant for purposes of the invention. For artistic and decorative purposes, the window covering may be colored, patterned or textured.

Structurally, window covering 20 includes an upper edge 22 commensurate in configuration with the upper part of window 10, frame 12 or adjacent wall surface 14. The upper edge may be attached either to the window, to the frame or to the wall surface by two or more patches (24, 26) of double-sided adhesive tape. Other attachment means, such as nails, thumbtacks, hooks, etc. may also be used, if feasible and prudent. Upper edge 22 may include a hem 28, as illustrated, to provide additional rigidity. For long span installations or window coverings which may be exceedingly limp, stiffening means may be added to upper edge 22 to prevent droop of the upper edge or a plurality of attachment points may be used.

The planform of window covering 20 may be rectangular, as illustrated, or of other shape commensurate with the size and configuration of window 10. Alternatively, it may be oversized in situations where minimized light transmissibility is of major concern or where decorative considerations so suggest.

Lower edge 30 of window covering 20 may be hemmed with hem 32, as illustrated, to add stiffness or rigidity to the lower edge. A bar or rod 34 may be inserted within the hem to further stiffen the lower edge. The rod will also add weight, which weight will encourage the window covering to hang straight.

Figure 2:
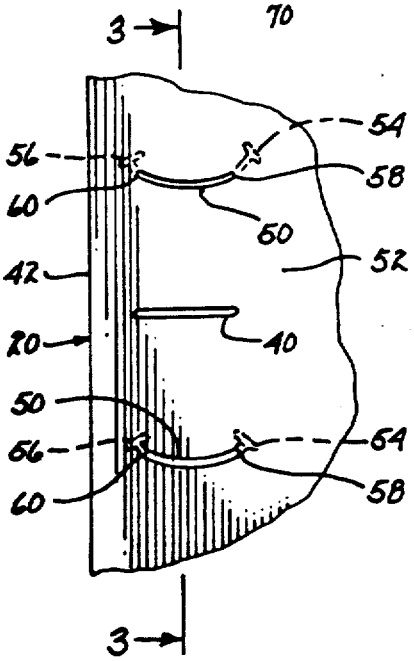
FIG. 2 is a partial view of the window covering and showing slots and loops of the window covering.
Figure 3:
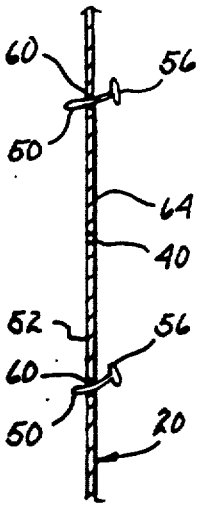
FIG. 3 is a partial view taken along lines 3—3, as shown in FIG. 2.

As shown in FIGS. 1, 2 and 3, a plurality of vertically aligned penetrable means, such as slots 40, are disposed proximate side edge 42 of window covering 20. A plurality of similar slots 44 are vertically aligned along side edge 46. It is intended that slots 40 be transversely generally aligned with slots 44. A plurality of loops 50 extend from rear surface 52 of window covering 20, which loops are in general vertical alignment with slots 40 along edge 42. These loops may be a strand of thread or plastic filament. The latter is particularly useful in that plastic filaments may be obtained which include integrally formed cross members 54,56 at each end. To install loops 50, cross member 54, after being bent into general alignment with the adjacent part of the filament, is penetrably inserted through aperture 58 in window covering 20. Similarly, cross member 56 is bent into general alignment with the adjacent part of the filament and inserted through aperture 60. The cross members, after self alignment transverse to the axis of the filament, will preclude withdrawal of the filament through apertures 58,60. A plurality of similar loops 62 are vertically aligned along edge 46 of window covering 20 and in general vertical alignment with slots 44. As particularly illustrated in FIGS. 2 and 3, the cross members of loops 50 and 62 are disposed adjacent front surface 64 of the window covering and the loop itself is disposed adjacent rear surface 52.

Figure 4:
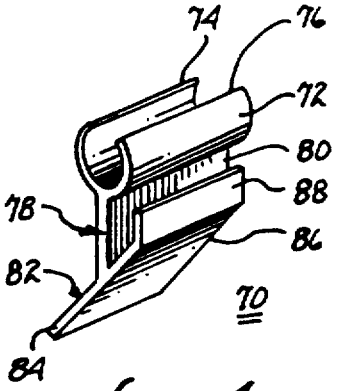
FIG. 4 is an isometric view of a clip usable with the window covering to retain it folded in place.

Referring jointly to FIGS. 1 and 4, clip 70 and its function will be discussed in detail. The clip includes retention means 72 for engaging lower edge 30. In the embodiment illustrated, the retention means is a segment of a split cylindrical sleeve having opposed longitudinal edges 74,76. The diameter of the retention means or sleeve 72 is a function of the diameter of rod 34 and the material of hem 32 extending thereabout, as illustrated in FIG. 1. Preferably, the sleeve is of resilient material to permit the sleeve to grippingly engage the partially encircled rod. Suspension means 78 for selective engagement with the slots and loops includes a support member 80 extending laterally from and in longitudinal alignment with sleeve 72. The support member supports a flange member 82 in a non perpendicular relationship therewith. The flange member includes a planar flange 82 set at an obtuse angle with respect to support member 80 and a hooked flange 86 set at an acute angle with regard to the support member. It may be noted that the planar flange and a substantial part of the hooked flange lie in a common plane and are an extension of one another. The length of each of slots 40,44 is commensurate with the width of flange member 82. Moreover, the width of each of the slots is sufficient to accommodate penetrable engagement by hooked flange 86. Similarly, the length of each of loops 50,62, exposed on side 64 of window covering 20, is commensurate with the width of planar flange 84. Necessarily, these loops must have sufficient slack to permit engagement with planar flange 84 of the respective clips without causing the adjacent portion of the window covering to buckle or have a hump.

Figure 7:
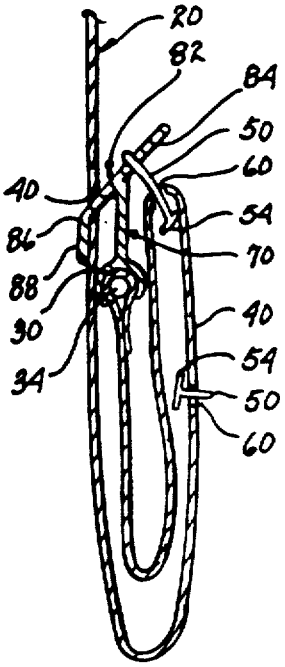
FIG. 7 is a cross sectional view taken along lines 7—7, as shown in FIG. 6.
Figure 5:
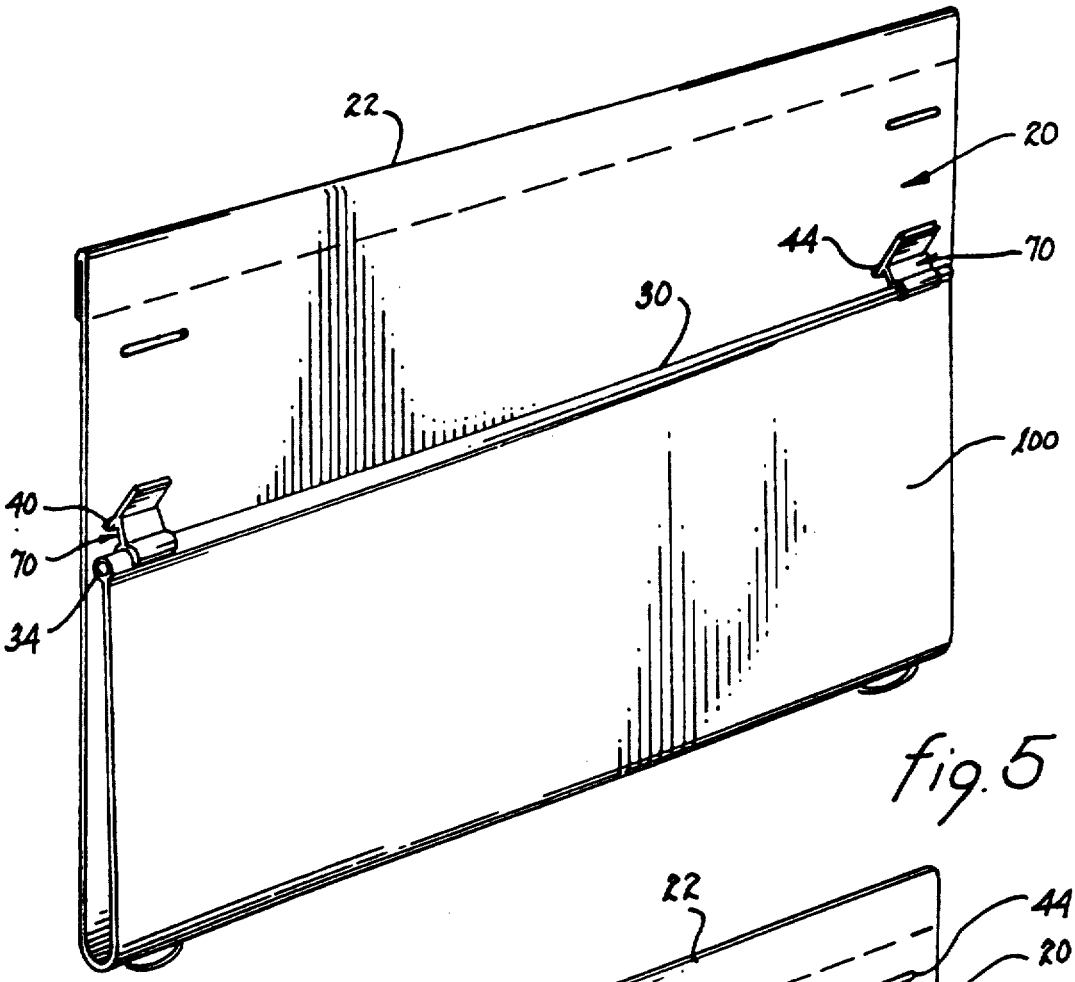
FIG. 5 is an isometric view showing the window covering in a single folded state.
Figure 6:
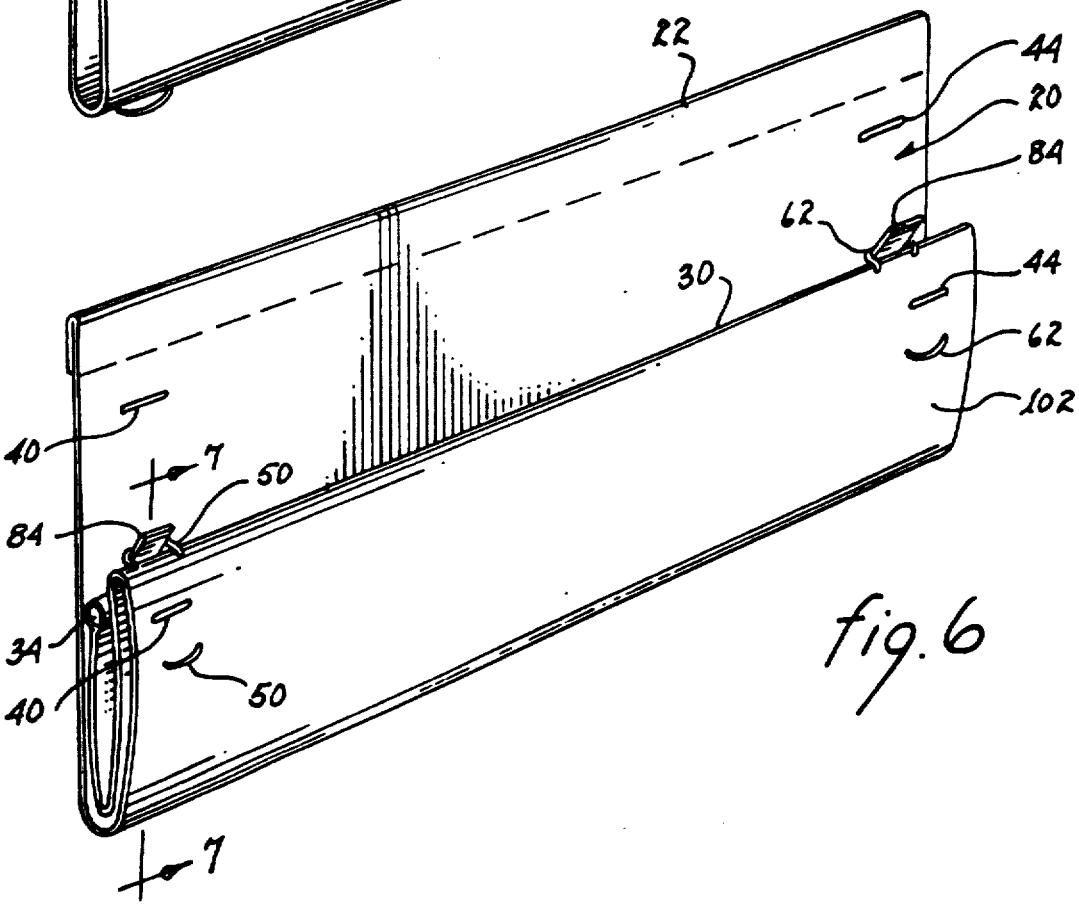
FIG. 6 is an isometric view showing the window covering in a double folded state.

Referring jointly to FIGS. 5, 6 and 7, the operation of the present invention will be described in detail. Window covering 20 depends from the upper part of the frame surrounding window 10, as illustrated in FIG. 1. Being of a length and width greater than the window, the window covering will cover the window. Rod 34, providing both weight and rigidity to bottom edge 30 of the window covering will tend to maintain the window covering generally flat and planar with the window. The additional weight provided by clips 70 may be of assistance in retaining the window covering in place.

To uncover a portion of window 10 for the purpose of letting in light or to see through the window, a lower part of the window covering is folded upwardly upon itself, as represented b first fold portion 100 illustrated in FIG. 5. The first fold portion is retained in place by penetrably engaging hooked flange 86 of flange member 82 with slot 40. A second clip 70 is in similar engagement with transversely aligned slot 44. Because of the angled relationship of hooked flange 86 with respect to support member 80 and the depending relationship of first fold portion 100, the weight of the first fold portion, including rod 34, will tend to urge penetration and maintain hooked engagement between clip 70 and window covering 20. With such urging, possible flapping of the window covering due to an airflow through an opened part of window 10 will generally not result in disengagement of first fold portion 100. Moreover, accidental brushing against the first fold portion will tend not to result in disengagement of clips 70 from the engaged slots.

To obtain yet further exposure of window 10, first fold portion 100 may be folded upon itself, as depicted by second fold portion 102, as shown in FIGS. 6 and 7. In this configuration, planar flanges 84 of the respective clips 70 are engaged by loops 50,62. Because of the angular orientation of the planar flanges, the weight of second fold portion 102 will tend to encourage and maintain penetrable engagement between the loops and the respective planar flanges.

To cover a portion of window 10, second fold portion 102 may be slightly lifted by drawing it upwardly and away from the respective clips 70 to bring about disengagement of loops 50,62 with the corresponding planar flanges of clips 70. Thereafter, second fold portion 102 may be released to permit it to drop. Similarly, first fold portion 100 is readily released by repositioning lower edge 30 upwardly and away from window 10 to disengage hooked flanges 86 of clips 70 with corresponding slots 40, 44. The lower edge may then be allowed to drop whereafter covering 20 will assume the position depicted in FIG. 1 to cover window 10.

A plurality of vertically spaced slots 40 and 44 in covering 20 permit altering the height of first fold portion 100 from a minimal height to approximately half of the height of window covering 20. A plurality of vertically spaced loops 50 and 62 are incorporated in window covering 20 to permit variations in height of second fold portion 102. Accordingly, the initial exposure of window 10 by first fold portion 100 may be incrementally increased by second fold portion 102 and depending upon which ones of transversely aligned loops 50,62 are brought into engagement with respective clips 70. With the configuration of loops illustrated in the figures, approximately ¾ of window 10 can be uncovered upon a maximum height of each of the first fold portion and the second fold portion.

Because the cross section of clip 70 is uniform throughout the longitudinal length of the clip, it is well adapted for manufacture by conventional extrusion techniques. Accordingly, an extended length of clip 70 can be readily manufactured of suitable plastic material at a very nominal cost. Thereafter, the length can be cut to any length segments suitable for the purposes described above. By forming clip 70 of material having a certain degree of resiliency and flexibility, any given diameter of retention means 72 can accommodate a range of different diametrically sized rods 34 and encircling hem 32. It is to be noted that the retention means can be otherwise configured to accommodate various means for attaching clip 70 to lower edge 30, whether the lower edge is flat, rectangular, circular, etc. Moreover, other fastening means may be employed to secure retention means 72 to the lower edge of the covering.

From the above description and the accompanying illustrations, it will be apparent that window covering 20 is relatively simple in structure and yet clip 70 is sufficiently sophisticated in design and configuration to permit great ease in folding over and retaining one or more folds of the window covering. Even though window covering 20 may be of sufficiently inexpensive material to be used as a temporary discardable covering, it is capable of providing all of the advantages of more conventional window coverings with respect to light control, privacy, selected exposure of the window and decorative value.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A method for selectively varying the vertical length of a horizontally foldable covering, said method comprising the steps of:

a) attaching the upper part of a horizontally foldable sheet of material to a supporting surface;

b) suspending the lower part of the sheet from a remaining part of the sheet with suspension means to fold the sheet and reduce the vertically suspended frontal area of the sheet, said step of suspending comprising the steps of:

1) engaging the suspension means with first engaging means disposed in one vertical section of the sheet to assist in suspending a folded part of the sheet;

2) attaching the suspension means with second engaging means disposed in an other vertical section of the sheet to assist in suspending the folded part of the sheet;

3) affixing the suspension means with third engaging means disposed in the one vertical section of the sheet and in the folded part of the sheet to assist in suspending a further folded part of the sheet; and 4) fastening the suspension means with a fourth engaging means disposed in the other vertical section of the sheet and in the folded part of the sheet to assist in suspending the further folded part of the sheet.

2. The method as set forth in claim 1 wherein each of said steps of engaging and attaching comprises the step of penetrably inserting the suspension means into the sheet.

3. The method as set forth in claim 1 wherein each of said steps of affixing and fastening comprises the step of looping a loop extending from the sheet with the suspension means.

4. The method as set forth in claim 3 wherein each of said steps of affixing and fastening comprises the step of looping a loop extending from the sheet with the suspension means.

5. The method as set forth in claim 1 including removably gripping the lower part of the sheet with the suspension means.

6. The method as set forth in claim 1 including removably gripping the lower edge off the covering with the suspension means.

7. A method for selectively varying the vertical length of a horizontally foldable covering attached to a supporting surface, said method comprising the steps of:

a) folding the lower part of the sheet over a remaining part of the covering with suspension means to reduce the vertically suspended area of the covering, said step of suspending comprising the steps of:
   1) engaging the suspension means with first engaging means disposed in one vertical section of the covering to assist in folding a lower part of the covering;
   2) attaching the suspension means with second engaging means disposed in an other vertical section of the covering to assist in folding the lower part of the covering;
   3) affixing the suspension means with third engaging means disposed in the one vertical section of the covering and in the folded part of the covering the assist in further folding the folded part of the covering; and
   4) fastening the suspension means with a fourth engaging means disposed in the other vertical section of the covering and in the folded part of the covering to assist in further folding the folded part of the covering.

8. The method as set forth in claim 2 wherein each of said steps of engaging and attaching comprises the step of penetratably inserting the suspension means into the covering.

9. The method as set forth in claim 8 wherein each of said steps of affixing and fastening comprises the step of looping a loop extending from the covering with the suspension means.

10. The method as set forth in claim 2 wherein each of said steps of affixing and fastening comprises the step of looping a loop extending from the covering with the suspension means.

11. A method for selectively varying the vertical length of a horizontally foldable covering attached to a supporting surface, said method comprising the steps of:

a) folding a lower part of the covering upon a section of the remaining covering, said step of folding comprising the steps of:
   1) engaging first suspension means affixes to the lower part of the covering with one vertical segment in the remaining section of the covering; and
   2) attaching second suspension means affixed to the lower part of the covering with another vertical segment in the remaining section of the covering;
b) further folding the folded lower part of the covering upon itself, said steps of further folding comprising the steps of:
   1) affixing the first suspension means with the folded lower part; and
   2) fastening the second suspension means with the folded lower part.

12. The method as set forth in claim 11 wherein the folded part of the covering includes first and second loops and wherein said steps of affixing and fastening comprise the steps of penetrably engaging the first and second suspension means with the respective first and second loops.

13. The method as set forth in claim 11 wherein the remaining section of the covering includes first and second apertures and wherein said steps of engaging and attaching comprise the steps of penetrably engaging the first and second suspension means with the respective first and second apertures.

14. The method as set forth in claim 13 wherein the remaining section of the folded party of the covering includes first and second loops and wherein the steps of affixing and fastening comprise the steps of penetrably engaging the first and second suspension means with the respective first and second loops.

* * * * *